US009775435B2

(12) United States Patent
Africa et al.

(10) Patent No.: US 9,775,435 B2
(45) Date of Patent: Oct. 3, 2017

(54) SHELF COMPONENT

(71) Applicant: ACCO Brands Corporation, Lake Zurich, IL (US)

(72) Inventors: Tom J. Africa, Lebanon, OH (US); Scott M. Cline, New Albany, OH (US); Ross C. Worden, Findlay, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 0 days.

(21) Appl. No.: 14/103,325

(22) Filed: Dec. 11, 2013

(65) Prior Publication Data

US 2014/0167581 A1 Jun. 19, 2014

Related U.S. Application Data

(60) Provisional application No. 61/737,173, filed on Dec. 14, 2012.

(51) Int. Cl.
*A47B 96/02* (2006.01)
*A47B 43/00* (2006.01)

(52) U.S. Cl.
CPC ..... *A47B 96/02* (2013.01); *A47B 43/003* (2013.01); *A47B 96/025* (2013.01)

(58) Field of Classification Search
CPC ..... A47B 43/00; A47B 43/003; A47B 43/006; A47B 57/06; A47B 57/08; A47B 57/16; A47B 57/20; A47B 65/00; A47F 5/08; A47F 5/0815; A47F 5/10; A47F 5/116
USPC ..... 312/351, 258; 108/149, 28, 30; 211/90.01, 90.02, 134, 149, 153, 186, 187
See application file for complete search history.

(56) References Cited

U.S. PATENT DOCUMENTS

| | | | | | |
|---|---|---|---|---|---|
| 1,560,436 | A * | 11/1925 | Staples | A47B 96/02 | 108/28 |
| 1,711,854 | A * | 5/1929 | Olander | 211/113 | |
| 1,816,705 | A * | 7/1931 | Arthur et al. | 108/1 | |
| 1,906,208 | A * | 4/1933 | Greenberg | 312/248 | |
| 1,937,935 | A * | 12/1933 | Zimmerman | 108/110 | |
| 2,651,559 | A * | 9/1953 | O'Connor | 312/329 | |
| 3,168,365 | A * | 2/1965 | Evans | 312/351 | |
| 3,332,655 | A * | 7/1967 | Buren, Jr. | A47B 57/58 | 108/149 |
| 4,537,451 | A | 8/1985 | Bredderman et al. | | |
| 5,105,954 | A * | 4/1992 | Dahlquist | 211/195 | |
| 5,154,500 | A * | 10/1992 | Chang | 312/258 | |
| 5,671,990 | A | 9/1997 | Teasdale | | |
| 5,746,331 | A * | 5/1998 | Kurtis | 211/149 | |
| 6,561,107 | B1 * | 5/2003 | Wood et al. | 108/132 | |

(Continued)

FOREIGN PATENT DOCUMENTS

GB 2394271 A * 4/2004 ..... D06F 58/10

*Primary Examiner* — Andrew Roersma
(74) *Attorney, Agent, or Firm* — Thompson Hine LLP

(57) ABSTRACT

A shelf component including a generally flat, planar base and a pair of side panels, each side panel being coupled to the base on opposite sides thereof. Each side panel is pivotally coupled to said base such that each side panel is positionable generally on a first side of the base. Each side panel has an opening configured to receive a mounting hook therethrough. The shelf component further includes a pair of extension hooks coupled to at least one of the side panels or the base. Each extension hook is positionable on a second side of the base that is opposite the first side.

9 Claims, 3 Drawing Sheets

(56) References Cited

U.S. PATENT DOCUMENTS

| | | | | |
|---|---|---|---|---|
| 6,814,418 | B2 * | 11/2004 | D'Orso | A47B 61/04 108/149 |
| 2003/0111434 | A1 * | 6/2003 | Stoddart | A47B 43/00 211/118 |
| 2006/0169659 | A1 * | 8/2006 | Robinson | A47B 57/30 211/187 |
| 2006/0288917 | A1 * | 12/2006 | Wood | 108/115 |
| 2009/0206711 | A1 * | 8/2009 | Glenn | A47B 43/003 312/108 |
| 2010/0163505 | A1 * | 7/2010 | Wang | A47B 96/04 211/134 |
| 2011/0042335 | A1 * | 2/2011 | McNicholas | 211/85.3 |
| 2011/0180502 | A1 * | 7/2011 | Clark et al. | 211/90.04 |

* cited by examiner

SHELF COMPONENT

This application claims priority to U.S. Provisional Application Ser. No. 61/737,173 entitled SHELF COMPONENT, filed on Dec. 14, 2012, the entire contents of which are incorporated by reference herein.

The present invention is directed to a shelf component, more particularly, to a shelf component which can be used with a locker or the like.

BACKGROUND

Students and others utilize lockers and other storage devices to secure books, coats, backpacks, files, folders, papers and other loose items. Some lockers may provide a single shelf to provide storage space, but the shelf is often inadequate to meet the storage needs of a user.

SUMMARY

In one embodiment, the present invention is a shelf component which can be utilized to provide a shelf, or an extra shelf or storage compartment, in a locker. More particularly, in one embodiment the invention is a shelf component including a generally flat, planar base and a pair of side panels, each side panel being coupled to the base on opposite sides thereof. Each side panel is pivotally coupled to said base such that each side panel is positionable generally on a first side of the base. Each side panel has an opening configured to receive a mounting hook therethrough. The shelf component further includes a pair of extension hooks coupled to at least one of the side panels or the base. Each extension hook is positionable on a second side of the base that is opposite the first side.

DETAILED DESCRIPTION

Figure 1:
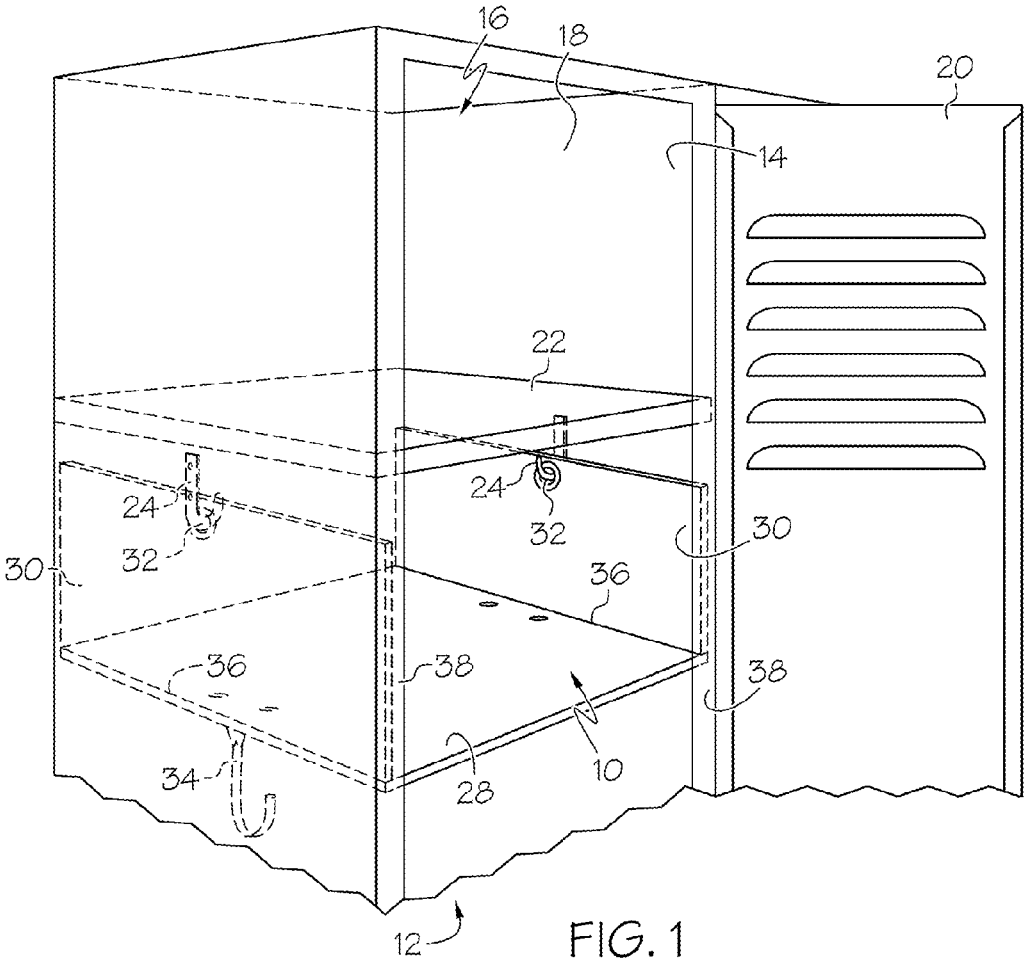
FIG. 1 is a front perspective view of one embodiment of the shelf component of the present invention, shown mounted inside a locker.

As shown in FIGS. 1-4, in one embodiment the present invention takes the form of a shelf component 10 which can be used in conjunction with a locker 12 or the like. The locker 12 may include a locker body 14 defining an inner volume 16 having a front opening 18. The locker 12 may include a locker door 20 that is hingedly coupled to the locker body 14 and can selectively cover/close the front opening 18 when the locker door 20 is in its closed position.

Figure 3:
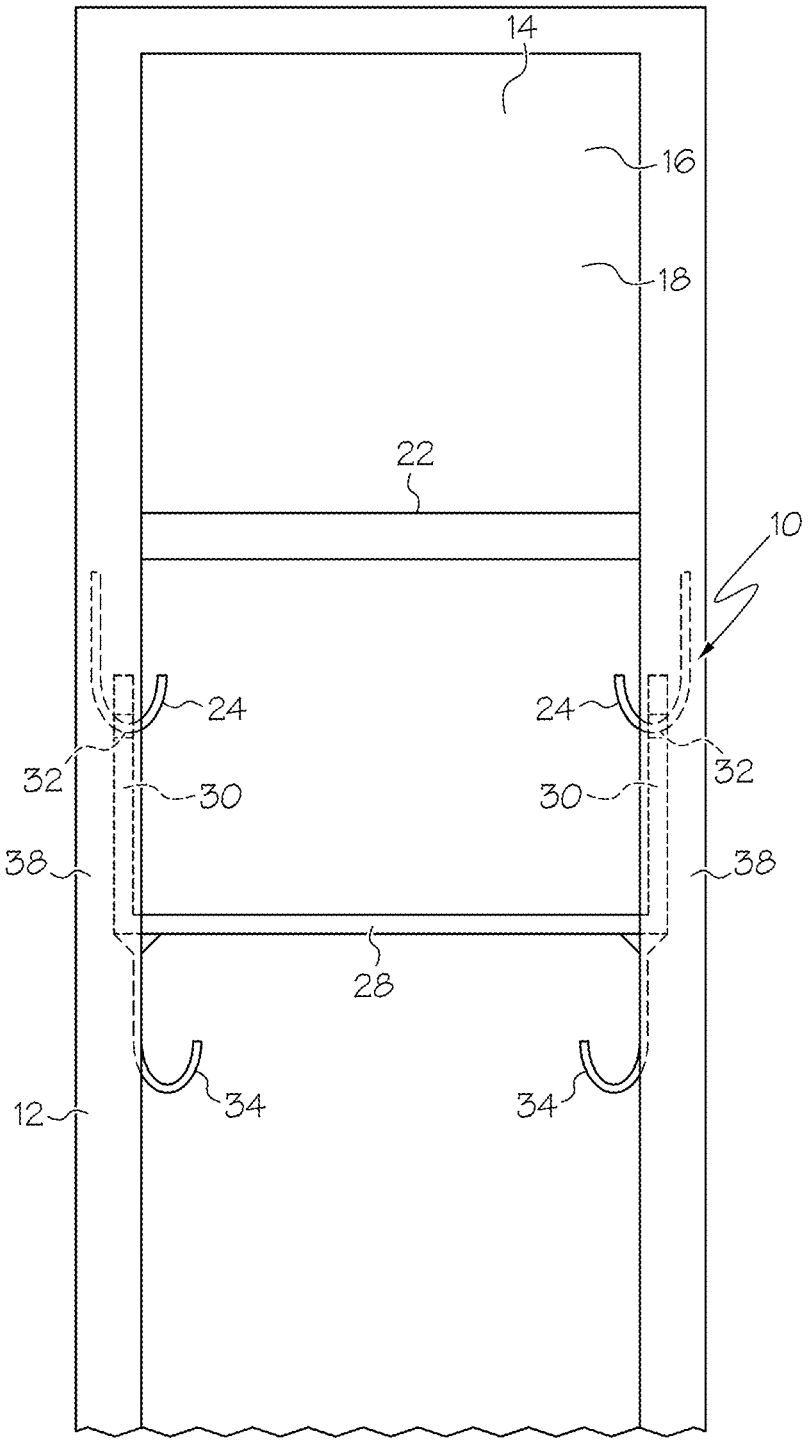
FIG. 3 is a front view of the locker and shelf component of FIG. 1.

As shown in FIGS. 1 and 3, the locker 12 may include a permanent, generally horizontally-oriented locker shelf 22 positioned in the inner volume 16 near an upper portion thereof. In one embodiment, a set of opposed mounting hooks 24 are positioned in the inner volume 16, coupled to the locker body 14 and/or underside of the locker shelf 22. In traditional use, a user can place books and other loose components on the permanent locker shelf 22, and hang a coat, backpack or other items from the mounting hooks 24.

In other cases, the locker 12 may lack the permanent shelf 22, but may still include the mounting hooks 24.

Figure 2:
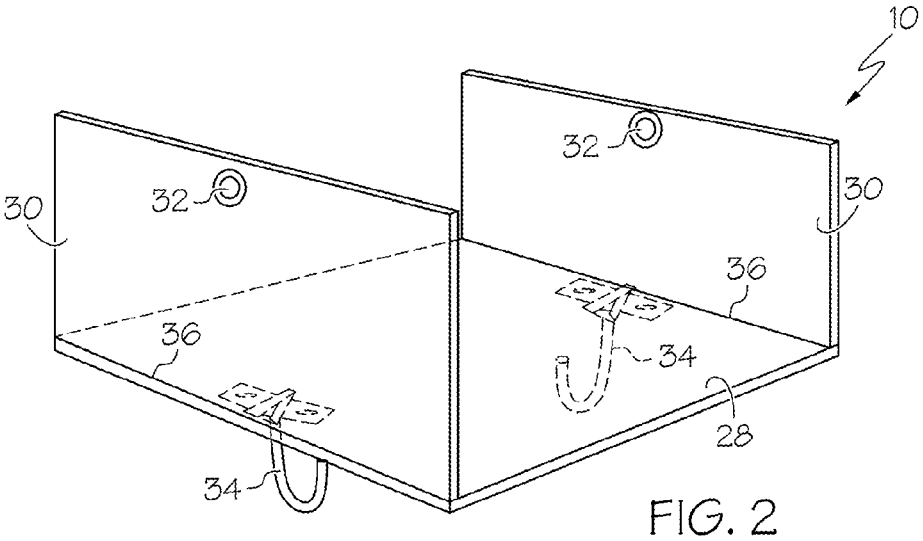
FIG. 2 is a front perspective view of the shelf component of FIG. 1.

In order to provide greater utility to the locker 12, the shelf component 10 can be coupled to and/or suspended from the locker body 14/permanent locker shelf 22/mounting hooks 24. In particular, in one embodiment the shelf component 10 includes a generally, flat planar base 28 and a pair of generally flat, planar side panels 30, each side panel 30 being coupled to opposite sides of the base 28. In its mounted configuration, as shown in FIGS. 1-3, each side panel 30 is oriented generally perpendicular to the base 28, and the base 28 is oriented generally parallel to the permanent locker shelf 22.

Each side panel 30 may include an opening 32 formed therein, wherein each opening 32 is positioned to receive a mounting hook 24 therethrough to thereby suspend the shelf component 10 and position it in place. Each opening 32 can be reinforced, and, in the illustrated embodiment, includes a reinforcing metal grommet positioned therein. However, the shelf component 10 may also be able to be coupled to the locker 12 by other means and mechanisms, such as by attaching directly to the permanent locker shelf 22.

When the shelf component 10 is installed in the locker 12, as shown in FIGS. 1 and 3, the base 28 defines a flat shelf surface upon which the user can place books, school supplies, clothes and other loose components. The shelf component 10 thereby provides another shelf for use inside the locker 12 (or the only shelf if the locker 12 lacks a permanent locker shelf 22). The shelf component 10 can be positioned lower than the permanent locker shelf 22 and therefore can be accessible to shorter and younger users of lockers 12, and provides improved visibility. In addition, the shelf component 10 can include one or more extension hooks 34 extending generally downwardly from the base 28. In the illustrated embodiment the extension hooks 34 are mounted to the base 28 of the shelf component 10, but could also or instead be mounted to the side panels 30. In the illustrated embodiment the extension hooks 34 are positioned on opposite lateral sides of the front opening 18 of the locker 12.

In one embodiment the side panels 30 are positioned on one side (i.e. the upper side, extending upwardly) of the base 28, and the extension hooks 34 are positioned on the other side (i.e. the lower side, extending downwardly) from the base 28. The extension hooks 34 can be laterally aligned with the openings 32/mounting hooks 24 in the depth direction (i.e. front to back of the locker 12 dimension) and in the width direction (i.e. left to right of the locker 12 dimension) when the shelf component 10 is mounted to the locker 12 such that the extension hooks 34 are positioned directly vertically below the openings 32/mounting hooks 24. In one case each extension hook 34 has generally the same size and shape as the mounting hooks 24. In this manner, the extension hooks 34 are provided in the same lateral location as the mounting hooks 24, and have the same size/shape so that the user can use the extension hooks 34 in a similar manner in which the mounting hooks 24 are used in the absence of the shelf component 10. However, in some cases the extension hooks 34 can have a different size, shape and/or location than the mounting hooks 24.

The shelf component 10 (and/or the panels 28, 30) can be made of a single unitary piece of material wherein the side panels 28 are pivotally coupled to the base along hinge lines 36. The shelf component 10 and panels 28, 30 may each be sufficiently stiff and/or rigid so as to remain generally planar when supported at any end thereof in a cantilevered fashion. In the illustrated embodiment, the side panels 30 are generally rectangular, but the side panels 30 can have any of a variety of other shapes or configurations.

Figure 4:
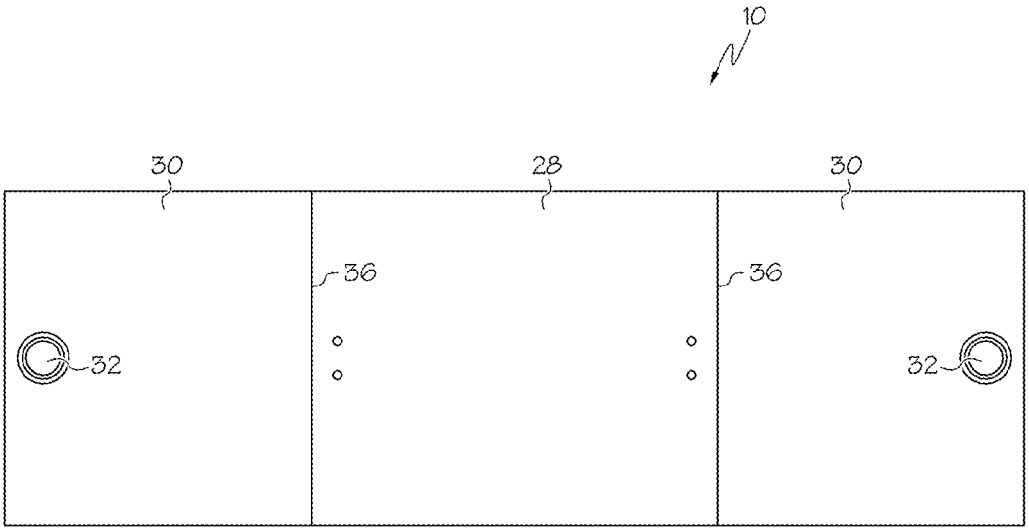
FIG. 4 is a top view of the shelf component of FIG. 1, shown in its flat configuration.

The shelf component 10 may be movable to a flat configuration, as shown in FIG. 4, wherein the shelf component 10 is generally flat and each of the panels 28, 30 are generally parallel and co-planar. The pivotable nature of the side panels 30 enables the shelf component 10 to be folded flat for ease of storage, packaging and transportation, and one or both of the side panels 30 can be pivoted on top of the base panel 28 to provide a compact storage arrangement.

The side panels 30 provide structural integrity to the shelf component 10 to reduce twisting, torsion, swinging, etc. of the component 10. The side panels 30 can also lay flat against the inner walls of the locker 12, and extend upwardly therealong, to assure there is no lateral gap between the base panel 28 and the walls of the locker (i.e. to prevent relatively small items such as pencils and the like from rolling off the sides of the base panel 28).

As best shown in FIG. 1, the locker body 14 may include a pair of opposed inwardly-extending lips 38, and the base panel 28 may have a lateral width greater than the lateral gap between the lips 38 (i.e. the width of the front opening 18). In this manner the base panel 28/shelf component 10 is retained in the inner volume 16 of the locker 12, and can only be removed by positioning the base panel 28 at an angle, which avoids inadvertent removal and ensures the shelf component 10 does not interfere with closing the door 20. In addition, when the side panels 30 are rectangular, their front edges can engage the lip 38, and the back edge engage the back surface of the locker body 14 so that the shelf component 20 is stably trapped in place.

In this manner the shelf component 10 provides a convenient storage devices which can be easily installed, can hang from the mounting hooks 24, and provides extension hooks 34 to replace the functionality provided by the mounting hooks 24.

Having described the invention in detail and by reference to the various embodiments, it should be understood that modifications and variations thereof are possible without departing from the scope of the claims of the present application.

What is claimed is:

1. A locker system comprising:

a locker body defining an inner volume, and one or more mounting hooks coupled to said locker body;

a permanent shelf oriented horizontally and positioned within said inner volume, said one or more mounting hooks positioned within said inner volume and positioned below said permanent shelf; and a shelf component comprising:

a generally flat, planar base;

a pair of side panels, each said side panel defining a first proximate end and a second distal end, said pair of side panels being coupled to said base at said first proximate ends on opposite sides of said base, both of said side panels projecting in an upward direction away from said base such that said distal ends of said side panels are both positioned in a location above the base, and said side panels and said base are together formed from a single, unitary piece of material, each said side panel being pivotally coupled to said base about an associated pivot axis such that each said side panel is positioned generally on a first upper side of said base, said associated pivot axes of the pair of side panels being parallel to each other and spaced apart by a pivot axis distance, each said side panel having an opening, and each said side panel having a length dimension perpendicular to the associated pivot axis that is less than said pivot axis distance and less than a length of said base in a same direction as the length dimension of the side panel to allow both said side panels to fold on top of said base, each said side panel having a width dimension extending in a direction parallel to the associated pivot axis, said base having a width dimension extending parallel to both said pivot axes, and wherein said width dimension of each said side panel and said width dimension of said base are equal, and wherein said opening of each said side panel removably receives one of said one or more mounting hooks therethrough; and wherein said shelf component further comprises a pair of extension hooks coupled to at least one of said side panels or said base, each said extension hook being positioned on a second side of said base that is opposite said first upper side, each said extension hook being positioned at or adjacent to an outer edge of said base.

2. The locker system of claim 1 wherein each said extension hook is generally aligned with and positioned vertically below the opening in one of said side panels and one of said mounting hooks.

3. The locker system of claim 1 wherein said mounting hooks extend downwardly relative to said permanent shelf, and said base of said shelf component is oriented generally parallel to said permanent shelf.

4. The locker system of claim 1, wherein said locker body has a front opening with a lateral width, and wherein said shelf component has a lateral width greater than said lateral width of said front opening.

5. The locker system of claim 1 wherein said locker body has a front opening, and wherein said extension hooks are positioned on opposite lateral sides of said front opening.

6. The locker system of claim 1 wherein each said side panel of said shelf component is generally flat and planar.

7. A method for using a shelf component comprising:

providing a shelf component, said shelf component including a base and a pair of side components, each said side component defining a first proximate end and a second distal end and being pivotally coupled to said base at said first proximate end such that each said side component is positionable generally perpendicular to said base on a first upper side of said base, both of said side panels projecting in an upward direction away from said base such that said distal ends of said side panels are both positioned in a location above the base, said side components and said base are together formed from a single, unitary piece of material, said shelf component further comprising a pair of extension hooks coupled to at least one of said side components or said base, each said extension hook being on a second side of said base that is opposite said first upper side, each said extension hook being positioned at or adjacent to an outer edge of said base;

positioning the side components of said shelf component at least partially on top of said base;

positioning said shelf component within a locker so that said base is generally parallel to a shelf of said locker;

pivoting each said side component outward and upward from said base until each said side component is generally perpendicular to said base; and passing a mounting hook through an opening in each said side component to secure said shelf component to said locker.

8. The method of claim 7 wherein each said side component has one said opening, and wherein the passing step includes passing one of a pair of said mounting hooks through each said opening.

9. The method of claim 1 wherein the passing step includes passing a first of a pair of said mounting hooks through one of said side components, and simultaneously or afterward passing a second of said pair of mounting hooks through another one of said side components such that both said mounting hooks are received through said side components at the same time.

* * * * *